United States Patent [19]

Johnston

[11] 4,218,911

[45] Aug. 26, 1980

[54] RIVET HEAD FORMING TOOL

[76] Inventor: Jerry A. Johnston, Rte. 6, Box 219, Conway, S.C. 29526

[21] Appl. No.: 9,249

[22] Filed: Feb. 2, 1979

[51] Int. Cl.[3] ..... B21J 15/40

[52] U.S. Cl. ..... 72/479; 72/391; 72/465

[58] Field of Search ..... 72/434, 476, 479, 482, 72/665, 453.17, 391; 29/243.53, 243.54

[56] References Cited

U.S. PATENT DOCUMENTS

| | | | |
|---|---|---|---|
| 2,353,559 | 7/1944 | Hajek | 72/465 |
| 2,354,914 | 8/1944 | Goldstein | 72/465 |
| 2,630,030 | 3/1953 | Gann | 72/465 |
| 3,124,981 | 3/1964 | Hedden | 72/453.17 |
| 3,442,112 | 5/1969 | Abromavage | 72/476 |
| 3,562,893 | 2/1971 | Winslow | 29/243.53 |

*Primary Examiner*—Francis S. Husar
*Assistant Examiner*—Gene P. Crosby
*Attorney, Agent, or Firm*—Bailey, Dority & Flint

[57] ABSTRACT

A tool is described for forming a rivet head in a shank portion opposite the manufactured head of a rivet of the type often used in the aircraft industry including a base and plunger for backing the shank portion with movement of the plunger responsive to impact of a rivet gun on the manufactured head opposite the shank.

5 Claims, 4 Drawing Figures

RIVET HEAD FORMING TOOL

BACKGROUND OF THE INVENTION

When joining pieces of flat stock such as often used in the aircraft industry, a heavy piece of metal of almost any type which happens to be at hand is often utilized in backing and supporting the shank portion of a rivet opposite the manufactured head for forming or fashioning a rivet head. Many formed heads of irregular configurations and often inadequate structural characteristics usually result. However, some sophisticated head forming apparatus is available such as that illustrated in U.S. Pat. No. 3,124,981. Such an apparatus would be unsuitable from a practical standpoint for forming rivet heads in a manual operation as is contemplated by the present invention.

Accordingly, it is an important object of this invention to provide a manual support tool for backing and forming a rivet head opposite a manufactured head carried within the stock being riveted.

Another important object of the invention is to provide an improved rivet head forming device having a backing and supporting member which may be readily positioned for defining a formed head of proper height, configuration and disposition.

BRIEF DESCRIPTION OF THE INVENTION

It has been found that a tool may be provided for forming a rivet head by utilizing an elongated tubular base carrying a plunger therein with means supporting the plunger in relation to a stock engaging surface carried by said base so that the force of a rivet gun is exerted against the plunger and the weight carried thereby forming a rivet head of a predetermined height and configuration.

BRIEF DESCRIPTION OF THE DRAWING

The construction designed to carry out the invention will be hereinafter described, together with other features thereof.

The invention will be more readily understood from a reading of the following specification and by reference to the accompanying drawing forming a part thereof, wherein an example of the invention is shown and wherein:

FIG. 3A is a sectional plan view illustrating rivet heads constructed in accordance with the prior art illustrating common defects therein, and FIG. 3B is a similar sectional view illustrating a rivet head constructed in accordance with the present invention and being of proper height and configuration.

DESCRIPTION OF A PREFERRED EMBODIMENT

A tool is illustrated for supporting and backing a formed rivet head on a shank passing through stock opposite a manufactured head engaged by a rivet gun. An elongated tubular base A has an open chamber therein. An elongated plunger B is carried for axial movement in the chamber. A stock engaging surface C is carried on one end of the base. Means maintaining an adjacent end of the plunger in spaced relation with the stock by an amount accommodating the height of the formed rivet head includes a stop member D. A weight E is carried by the plunger opposite the adjacent end thereof. Thus, the force of the rivet gun is exerted against the plunger and the weight carried thereby supporting and backing the formed rivet head. The weight E serves as a convenient handle so that the tool may be held by the operator while forming a rivet head in lieu of the usual backing member.

Figure 2:
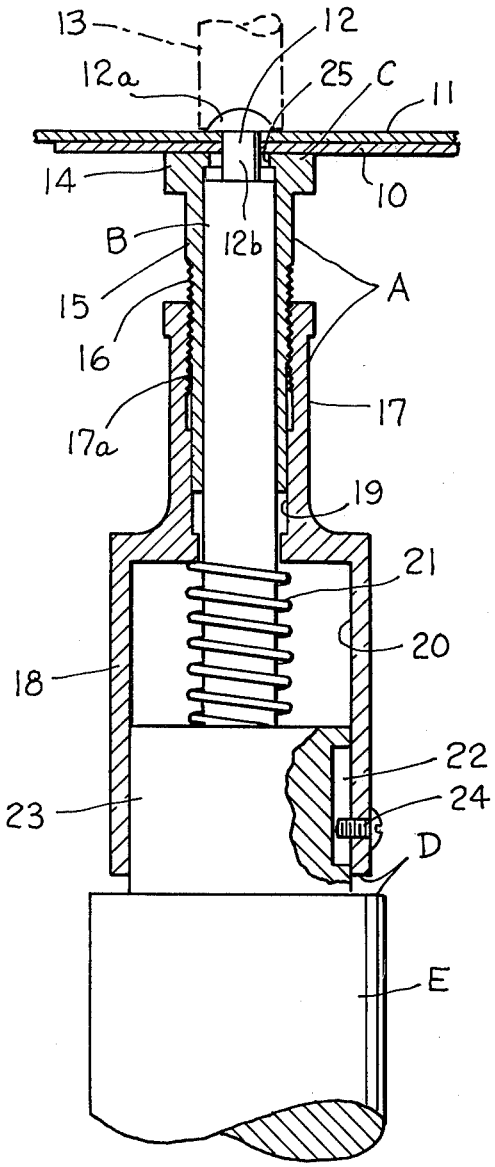
FIG. 2 is a transverse sectional elevation illustrating the tool in position having received a rivet shank portion therein for forming a head thereon.
Figure 1:
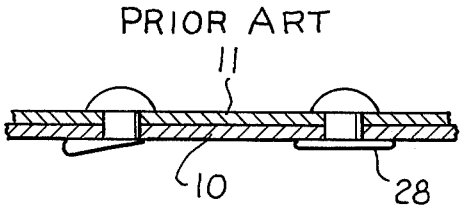
FIG. 1 is a perspective view illustrating a tool for supporting and backing a formed rivet head constructed in accordance with the present invention, illustrating a tubular base for receiving the shank portion of a rivet for engagement by the plunger carried within the base.
Figure 1:
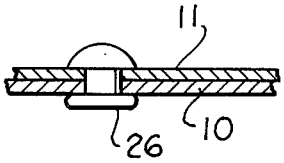
Figure 1:
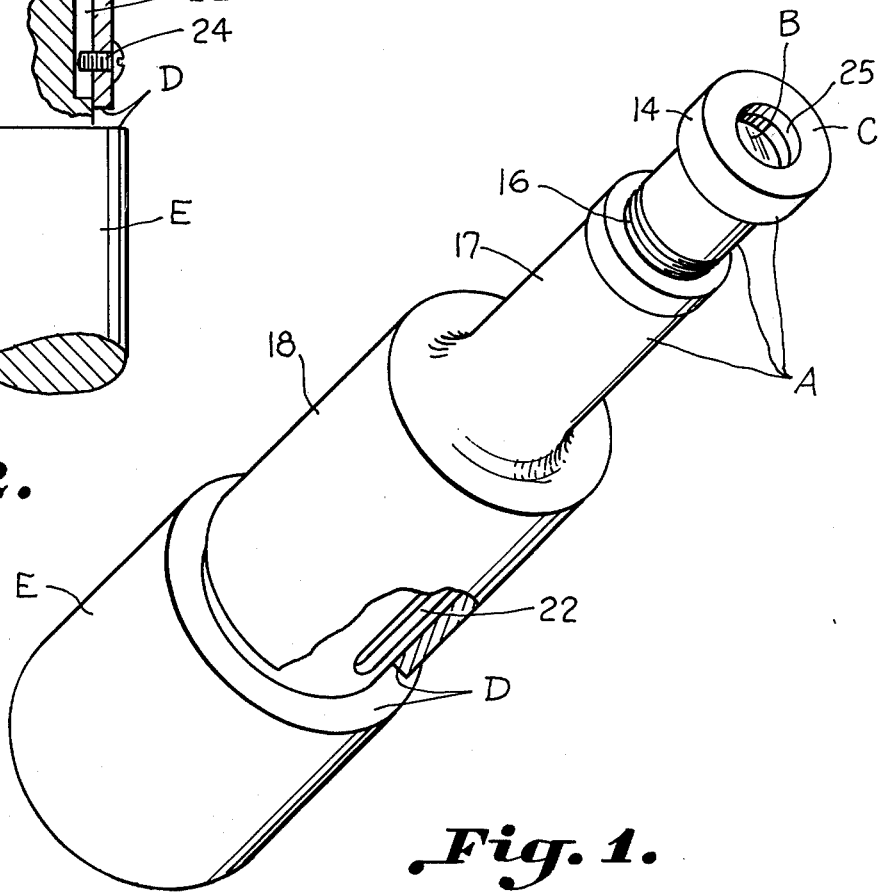

Referring more particularly to FIGS. 1 and 2, it will be noted that the stock engaging surface C is illustrated as being pressed against a flat surface of sheet stock illustrated as consisting of two pieces 10 and 11, aligned to be joined by the rivet 12. The rivet 12 has a manufactured head **12*a* and a shank 12*b*. A rivet gun is illustrated in broken lines as at 13, for exerting the force against the manufactured head 12*a* for forming a head in the shank 12*b*. It will be noted that the tubular base A includes an enlarged cylindrical end portion 14 for carrying the stock engaging surface C. The tubular base further includes a tubular extension 15 which has a threaded portion 16 for threadable engagement within a tubular member 17, which is carried by a housing 18. The internally threaded portion 17*a* of the tubular member 17 adjustably receives the tubular threaded portion 16** to provide for an adjustment between the stock engaging surface C and the plunger for determining the height of the rivet head.

It will be noted that the chamber 19, carried within the base A for receiving and guiding the plunger includes an enlarged extension 20 formed within the housing 18 wherein a compression spring 21 is housed. A key-way 22 is carried within an enlarged portion 23 which joins the plunger B and the weight E. The weight may be a continuation of the plunger cross section but such would be the weight portion illustrated. The key-way 22 is secured by means of a screw 24 which permits limited movement dictated by the means which is provided in the form of stop members D consisting of an inner end of the housing 18 and an adjacent enlarged end of the weight E.

It will be observed, that the base portion 14 has an inwardly extending lip adjacent the stock engaging surface C illustrated at 25. This keeps the formed rivet head away from the edge of the plunger. The compression spring 21 permits the base to engage and press the stock and the apparatus into proper position before the plunger engages the rivet. The plunger is pushed by the spring away from the rivet before pressure is applied.

Thus, a manually usable tool is provided capable of producing rivet heads 26 of proper configuration with uniform structural characteristics as illustrated in FIG. 3B as opposed to prior art crows foot heads 27 and a head which is too thin as illustrated at 28.

While a preferred embodiment of the invention has been described using specific terms, such description is for illustrative purposes only, and it is to be understood that changes and variations may be made without departing from the spirit or scope of the following claims.

I claim:

1. A tool for supporting and backing while forming a rivet head on a shank passing through stock opposite a manufactured head engaged by a rivet gun comprising:

an elongated tubular base having an open central chamber therein;

an elongated plunger carried for axial movement in said central chamber;

a stock engaging surface carried on one end of said base;

means maintaining an adjacent end of said plunger in spaced relation with said stock by an amount accommodating the height of the formed rivet head; and a weight carried by said plunger opposite said adjacent end thereof;

whereby the force of the rivet gun is exerted against the plunger and the weight carried thereby supporting and backing the rivet while the head is being formed

2. The structure set forth in claim 1 wherein said base and said plunger are cylindrical, and including means limiting the movement between said base and said plunger, including a housing adjustably carried for axial adjustment in relation to said stock engaging surface.

3. The structure set forth in claims 1 or 2 including resilient means within said base urging said plunger away from said shank.

4. The structure set forth in claim 1 wherein said base has an inwardly extending lip adjacent said stock engaging surface.

5. The structure set forth in claim 4 wherein said base and plunger are cylindrical and include a resilient mounting means for urging said plunger away from said shank.

* * * * *